US005096795A

United States Patent [19]

Yu

[11] Patent Number: 5,096,795

[45] Date of Patent: Mar. 17, 1992

[54] MULTILAYERED PHOTORECEPTOR CONTAINING PARTICULATE MATERIALS

[75] Inventor: Robert C. U. Yu, Webster, N.Y.

[73] Assignee: Xerox Corporation, Stamford, Conn.

[21] Appl. No.: 516,989

[22] Filed: Apr. 30, 1990

[51] Int. Cl.[5] ..... G03G 5/14

[52] U.S. Cl. ..... 430/59; 430/58; 430/60

[58] Field of Search ..... 430/58, 59, 60

[56] References Cited

U.S. PATENT DOCUMENTS

| | | | |
|---|---|---|---|
| 3,121,006 | 2/1964 | Middleton et al. | 96/1 |
| 3,357,989 | 12/1967 | Bryne et al. | 260/314.5 |
| 3,442,781 | 5/1969 | Weinberger | 204/181 |
| 3,880,657 | 4/1975 | Rasch | 96/1.5 |
| 3,915,735 | 10/1975 | Moreland | 106/308 Q |
| 3,936,183 | 2/1976 | Sadamatsu | 355/15 |
| 3,973,845 | 8/1976 | Lindblad et al. | 355/15 |
| 4,265,990 | 5/1981 | Stolka et al. | 430/59 |
| 4,279,500 | 7/1981 | Kondo et al. | 355/15 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,390,609 | 6/1983 | Wiedemann | 430/58 |
| 4,404,574 | 9/1983 | Burwasser et al. | 346/153.1 |
| 4,415,639 | 11/1983 | Horgan | 430/57 |
| 4,464,450 | 8/1984 | Teuscher | 430/59 |
| 4,469,771 | 9/1984 | Hasegawa et al. | 430/66 |
| 4,515,882 | 5/1985 | Mammino et al. | 430/58 |
| 4,519,698 | 5/1985 | Kohyama et al. | 355/15 |
| 4,563,408 | 1/1986 | Lin et al. | 430/59 |
| 4,647,521 | 3/1987 | Oguchi et al. | 430/58 |
| 4,664,995 | 5/1987 | Horgan et al. | 430/59 |
| 4,675,262 | 6/1987 | Tanaka | 430/58 |
| 4,678,731 | 7/1987 | Yoshizawa et al. | 430/65 |
| 4,713,308 | 12/1987 | Yoshizawa et al. | 430/65 |
| 4,716,091 | 12/1987 | Yoshihara et al. | 430/66 |
| 4,717,637 | 1/1988 | Yoshizawa et al. | 430/65 |
| 4,734,347 | 3/1988 | Endo et al. | 430/66 |
| 4,752,549 | 6/1988 | Otsuka et al. | 430/58 |
| 4,784,928 | 11/1988 | Kan et al. | 430/58 |
| 4,849,264 | 7/1989 | Pekar et al. | 427/388.1 |
| 5,869,982 | 9/1989 | Murphy | 430/48 |

*Primary Examiner*—Marion E. McCamish
*Assistant Examiner*—S. Rosasco
*Attorney, Agent, or Firm*—Oliff & Berridge

[57] ABSTRACT

In an electrophotographic imaging device, material for exposed layers and members has particles homogeneously dispersed therein. The particles provide coefficient of surface contact friction reduction, increased wear resistance, durability against tensile cracking, and improved adhesion of the layers without adversely affecting the optical and electrical properties of the imaging member.

20 Claims, 1 Drawing Sheet

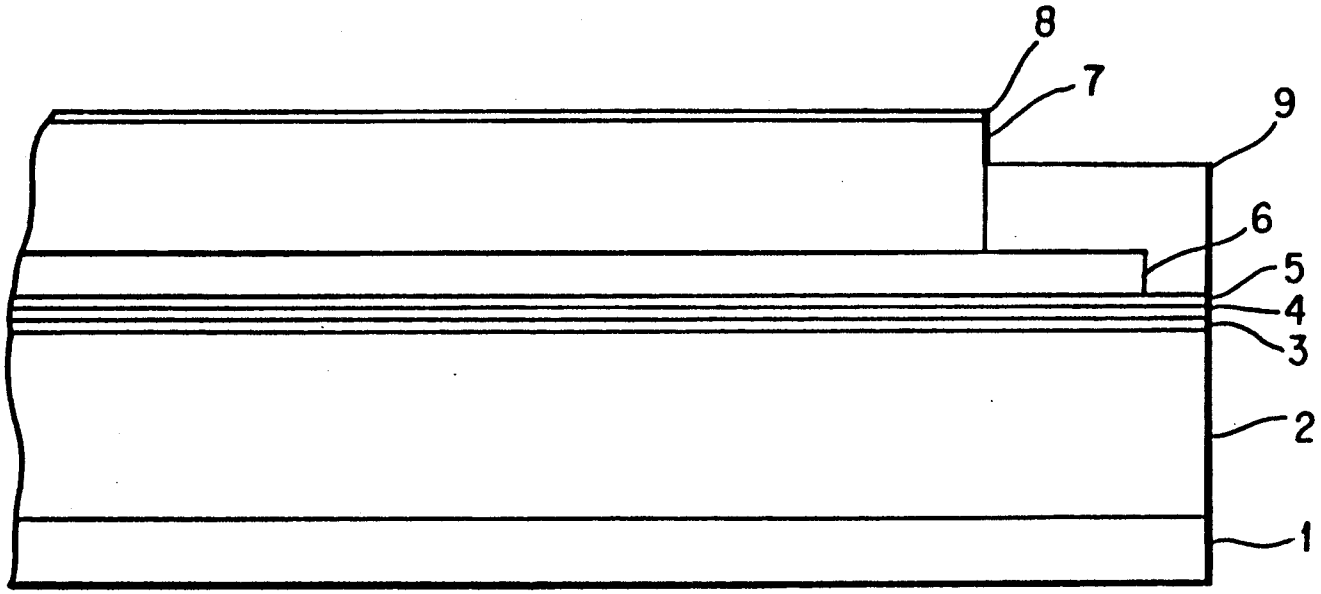
8
7
9
6
5
4
3
2
1

MULTILAYERED PHOTORECEPTOR CONTAINING PARTICULATE MATERIALS

BACKGROUND OF THE INVENTION

This invention relates in general to electrophotography and, in particular, to an electrophotographic imaging member.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

Imaging members are generally exposed to repetitive electrophotographic cycling which subjects the exposed charge transport layer thereof to abrasion, chemical attack, heat and multiple exposures to light. This repetitive cycling leads to a gradual deterioration in the mechanical and electrical characteristics of the exposed charge transport layer. Attempts have been made to overcome these problems. However, the solution of one problem often leads to additional problems.

In a production web stock of several thousand feet of coated multilayered photoreceptor roll-up, the charge transport layer and the anti-curl layer are in intimate contact. The high surface contact friction of the charge transport layer against the anti-curl layer causes dimples and creases to develop in the internal layers of the photoreceptor. These physically induced defects are seen to manifest themselves into print defects in xerographic copies.

When ultrasonically welded into a belt, seams in some multilayered photoresponsive imaging members can delaminate during fabrication when larger webs are slit into smaller belt size sheets. Further, after the sheets are welded into belts, the belts tend to delaminate during extended cycling over small diameter support rollers or when subjected to lateral forces caused by rubbing contact with stationary web edge guides during cycling Seam delamination is further aggravated when the belt is employed in electrophotographic imaging systems utilizing blade cleaning devices. In addition, belt delamination is encountered during web slitting operations to fabricate belt photoreceptors from wide webs. Alteration of materials in the various belt layers such as the conductive layer, hole blocking layer, adhesive layer, charge generating layer, and/or charge transport layer to reduce delamination is not easily effected because the new materials may adversely affect the overall electrical, mechanical and other properties of the belt such as residual voltage, background, dark decay, flexibility and the like.

U.S. Pat. No. 4,869,982 discloses an electrophotographic photoreceptor containing a toner release material in a charge transport layer. From about 0.5 to about 20 percent of a toner release agent selected from stearates, silicon oxides and fluorocarbons is incorporated into a charge transport layer.

U.S. Pat. No. 4,784,928 to Kan et al discloses an electrophotographic element having two charge transport layers. An outermost charge transport layer or overcoating may comprise a waxy spreadable solid, stearates, polyolefin waxes, and fluorocarbon polymers such as Vydax fluorotelomer from du Pont and Polymist F5A from Allied Chemical Company.

U.S. Pat. No. 4,664,995 discloses an electrostatographic imaging member utilizing a ground strip. The disclosed ground strip material comprises a film forming binder, conductive particles and microcrystalline silica particles dispersed in the film forming binder, and a reaction product of a bi-functional chemical coupling agent which interacts with both the film forming binder and the microcrystalline silica particles.

U.S. Pat. No. 4,717,637 discloses a microcrystalline silicon barrier layer.

U.S. Pat. Nos. 4,678,731 and 4,713,308 disclose microcrystalline silicon in the photoconductive and barrier layers of a photosensitive member.

U.S. Pat. No. 4,675,262 discloses a charge transport layer containing powders having a different refractive index than that of the charge transport layer excluding the powder material The powder materials include various metal oxides.

U.S Pat. No. 4,647,521 discloses the addition of amorphous hydrophobic silica powder to the top layer of a photosensitive member. The silica is of spherical shape and has a size distribution between 10 and 1000 Angstroms. Hydrophobic silica is a synthetic silica having surface silanol (SiOH) groups replaced by hydrophobic organic groups such as —$CH_3$.

If a relatively great frictional force acts between the photosensitive member and a cleaning member, the surface of the photosensitive member may be damaged, and wear-off or filming of the toner may result due to the high surface contact friction between the cleaning device and the charge transport layer of the photosensitive member Wear in the photosensitive member surface caused by high frictional force during machine function reduces the thickness of the charge transport layer. This reduction in charge transport layer thickness increases the electrical field across the layer, and alters electrophotographic performance. Moreover, static electricity generated by friction results in nonuniform surface potential in the charging step, which in turn causes an irregular image formation or fogging. In order to reduce the frictional force, the pressure of the cleaning member, e.g., a cleaning blade, may be reduced. However, by reducing the frictional force, the cleaning blade may not be able to clean the photosensitive member sufficiently, resulting in toner build-up or surface filming.

Other attempts at reducing the frictional force acting between the cleaning blade and the photosensitive member include adding a lubricant such as wax to the toner. However, the fixability of the toner may degrade its electrical function, or further filming may occur, resulting in a degraded image.

A further proposal for reducing frictional force involves applying a lubricant on the surface of the photosensitive drum. U.S. Pat. No. 4,519,698 discloses a waxy lubricant method to constantly lubricate a cleaning blade. However, the thickness of the lubricant film formed on the photosensitive drum cannot be maintained, and interference with the electrostatic characteristics of the photosensitive member occurs. Attempts have also been made to construct a cleaning blade with a material having a low coefficient of friction. However, these attempts are subject to the problem of degradation in other characteristics, especially mechanical strength, due to the presence of additives.

Another problem in multilayered belt imaging systems includes cracking in one or more critical imaging layers during belt cycling over small diameter rollers. Cracks developed in the charge transport layer during cycling are a frequent phenomenon and are most problematic because they can manifest themselves as print-out defects which adversely affect copy quality. Charge transport layer cracking has a serious impact on the versatility of a photoreceptor and reduces its practical value.

When one or more photoconductive layers are applied to a flexible supporting substrate, it has been found that the resulting photoconductive member tends to curl. An anti-curl layer may be applied to the side of the supporting substrate opposite the photoconductive layer to counteract the tendency to curl.

It is desirable to increase the durability and extend the life of the exposed charge transport layer surface in an imaging device as well as to reduce frictional contact between members of the imaging device while maintaining electrical and mechanical integrity.

SUMMARY OF THE INVENTION

It is an object of the invention to reduce wear and increase durability of an exposed charge transport layer in a photosensitive device.

It is also an object of the invention to reduce frictional contact between contacting members in an imaging device.

It is another object of the invention to provide an electrophotographic imaging member having improved wear resistance of the exposed charge transport layer, and to maintain the optical and electrical integrity of the layer.

It is still another object of the invention to provide an electrophotographic imaging member that is free of dimples and creases.

It is yet another object of the invention to provide an electrophotographic imaging member with improved charge transport layer resistance to tensile stress cracking.

It is a further object of the present invention to provide an improved electrophotographic imaging member having a charge transport layer which exhibits greater resistance to layer delamination.

It is still a further object of the present invention to provide particulate materials for increasing wear resistance.

It is a further object of the present invention to provide an electrophotographic imaging member with a charge transport layer which is more resistant to filming.

It is yet another object of the present invention to provide an electrophotographic imaging member having an improved wear resistant optional overcoating layer which maintains the optical clarity and electrical integrity of the overcoating layer.

The present invention overcomes the shortcomings of the prior art by providing a charge transport layer in an imaging member comprising particulate material. Homogeneously dispersed particles are incorporated in this exposed layer of an electrophotographic imaging member. Two types of filler particles employed to achieve this purpose are (1) inorganic particles such as microcrystalline silica, and (2) organic particles such as polytetrafluoroethylene particles available from Ausimont U.S.A., Inc as ALGOFLON and POLYMIST, and micronized waxy polyethylene particles available from Allied-Signal, Inc. as ACUMIST. The particle size of the above particles may range from about 0.1 micrometer to about 4.5 micrometers in diameter, with an average particle diameter of about 2.5 micrometers.

BRIEF DESCRIPTION OF THE DRAWINGS

A more complete understanding of the present invention can be obtained by reference to the accompanying FIGURE, which is a cross-sectional view of a multilayer photoreceptor of the invention.

DESCRIPTION OF PREFERRED EMBODIMENTS

The electrophotographic imaging member according to the present invention contains at least one layer which includes homogeneously dispersed particulate material. The homogeneous dispersion of particulate materials of the present invention in film forming polymer binder of, e.g., the charge transport layer, provides a reduced coefficient of surface friction without adverse effects on electrical properties.

A representative structure of an electrophotographic imaging member is shown in the FIGURE. This imaging member is provided with an anti-curl back coating 1, a supporting substrate 2, an electrically conductive ground plane 3, a blocking layer 4, an adhesive layer 5, a charge generating layer 6, and a charge transport layer 7. An optional overcoating layer 8 is also shown in the FIGURE.

In the above described device, a ground strip 9 may be provided adjacent the charge transport layer at an outer edge of the imaging member. See U.S. Pat. No. 4,664,995. The ground strip 9 is coextruded with the charge transport layer so as to provide grounding contact with a grounding device (not shown) during electrophotographic processes.

A description of the layers of the electrophotographic imaging member shown in the FIGURE follows.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex, available from ICI Americas Inc.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Blocking Layer

After deposition of the electrically conductive ground plane layer, the blocking layer 4 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)-methyl diethoxysilane, as disclosed in U.S. Pat. Nos. 4,338,387, 4,286,033 and 4,291,110. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

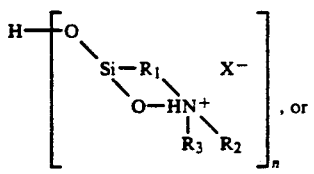

, or I

-continued

II

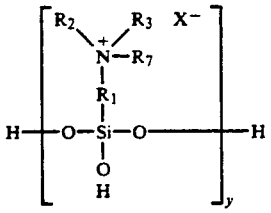

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 12–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for optimum electrical behavior The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

The Adhesive Layer

In most cases, intermediate layers between the blocking layer and the adjacent charge generating or photogenerating layer may be desired to promote adhesion. For example, the adhesive layer 5 may be employed. If such layers are utilized, they preferably have a dry thickness between about 0.001 micrometer to about 0.2 micrometer. Typical adhesive layers include film-forming polymers such as polyester, du Pont 49,000 resin (available from E. I. du Pont de Nemours & Co.), Vitel-PE100 (available from Goodyear Rubber & Tire Co.), polyvinylbutyral, polyvinylpyrrolidone, polyurethane, polymethyl methacrylate, and the like.

The Charge Generating Layer

Any suitable charge generating (photogenerating) layer 6 may be applied to the adhesive layer 5. Examples of materials for photogenerating layers include inorganic photoconductive particles such as amorphous selenium, trigonal selenium, and selenium alloys selected from the group consisting of seleniumtellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 (trade names for dibromo anthanthrone pigments), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating layer. Typical polymeric film forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The Charge Transport layer

The charge transport layer 7 may comprise any suitable transparent organic polymer or non-polymeric material capable of supporting the injection of photogenerated holes or electrons from the charge generating layer 6 and allowing the transport of these holes or electrons through the organic layer to selectively discharge the surface charge. The charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is normally transparent in a wavelength region in which the photoconductor is to be used when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds or charge transport molecules dispersed in normally electrically inactive film forming polymeric materials for making these materials electrically active. These charge transport molecules may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine, and about 75 percent to about 25 percent by weight of a polymeric film forming resin in which the aromatic amine is soluble.

The charge transport layer is preferably formed from a mixture comprising at least one aromatic amine compound of the formula:

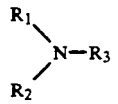

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron withdrawing groups such as $NO_2$ groups, CN groups, and the like. Typical aromatic amine compounds that are represented by this structural formula include:

I. Triphenyl amines such as:

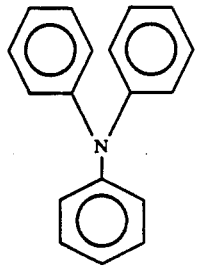

II. Bis and poly triarylamines such as:

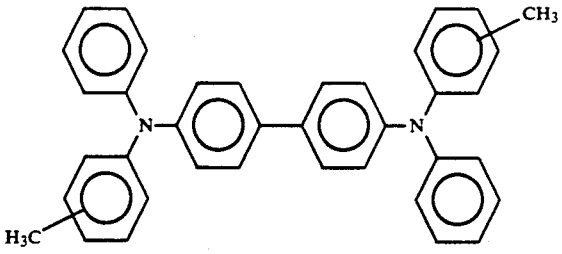

III. Bis arylamine ethers such as:

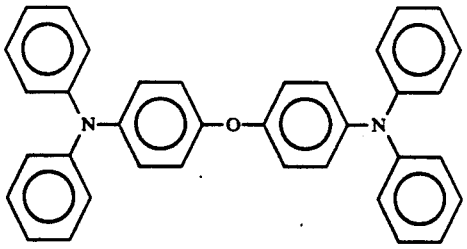

and

IV. Bis alkyl-arylamines such as:

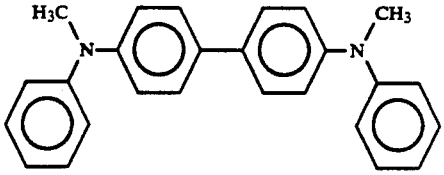

A preferred aromatic amine compound has the general formula:

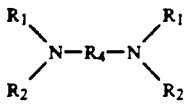

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron withdrawing groups such as $NO_2$ groups, CN groups, and the like.

Examples of charge transporting aromatic amines represented by the structural formulae above include triphenylmethane, bis(4-diethylamine-2l-methylphenyl)phenylmethane; 4'-4''-bis(diethylamino)-2',2''-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3''-methylphenyl)-(1,1'biphenyl)-4,4'-diamine; and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A.G.; a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000, having dispersed therein from about 25 to about 75 percent by weight of one or more compounds having the formula:

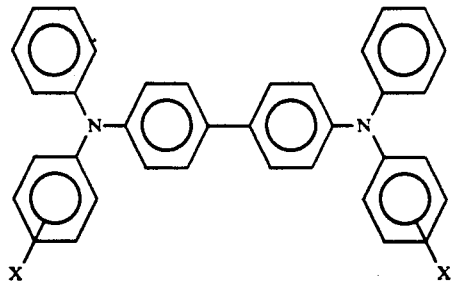

wherein X is selected from the group consisting of an alkyl group, having from 1 to about 4 carbon atoms, and chlorine, the photoconductive layer exhibiting the capability of photogeneration of holes and injection of the holes, the hole transport layer being substantially nonabsorbing in the spectral region at which the photoconductive layer generates and injects photogenerated holes but being capable of supporting the injection of photogenerated holes from the photoconductive layer and transporting the holes through the hole transport layer.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip may comprise a film forming polymer binder and electrically conductive particles. Cellulose may be used to disperse the conductive particles. Any suitable electrically conductive particles may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Anti-Curl Layer

The anti-curl layer 1 may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film forming resin and an adhesion promoter polyester additive. Examples of film forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl layer is from about 3 micrometers to about 35 micrometers, and preferably about 14 micrometers.

The Overcoating Layer

The optional overcoating layer 8 may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

The Particulate Materials

Two specific types of filler particles chosen for the present invention are inorganic and organic fillers. These fillers are selected for suitable particle dispersion. The fillers are easily dispersed by conventional coating solution mixing techniques and result in no particle agglomerations in the ry charge transport layer or overcoating layer. The fillers further have inherent wear resisting characteristics and are capable of providing lubricity to ease the sliding mechanical nteraction at the charge transport layer surface. The fillers ave refractive indices closely matched with that of the binder olymer so that particle dispersions in the polymer matrix do not affect the optical transmittancy of the layer. Very importantly, the presence of the fillers of the present invention produces no adverse impact on the electrical performance of the resulting photoconductive imaging member.

An inorganic filler of particular interest is microcrystalline silica, a naturally occurring irregular shape quartz particle which is available from Malvern Minerals Company. Microcrystalline silica also exists in two other forms (christobalite and tridymite). The microcrystalline silica of the present invention has a Moh Hardness Number of about 7 with excellent inherent abrasion resistance. Compared to the Moh Hardness Number of 5.5 for a synthetic amorphous silica counterpart, the microcrystalline silica is a mechanically superior filler for wear resistance enhancement. Other particulates of silica derivatives, such as micron size ground glass and micron size synthetic glass spheres (available from Cataphote Division, Ferro Corporation), are also good inorganic fillers for charge transport layer incorporation. To improve filler-polymer interaction, the microcrystalline silica particles may be surface treated with only two specific bifunctional silane coupling agents. Although numerous silane coupling agents are available for silica particle treatment, not all are suitable. Chloropropyl triethoxy silane, having a molecular formula $Cl(CH_2)_3Si(OC_2H_5)_3$, and azido silane, having a molecular formula $$N_3\overset{\overset{O}{\|}}{\underset{\underset{O}{\|}}{S}}-R-Si(OC_2H_5)_3,$$

are selected for the reason that they do not affect the delicate hole transport mechanism of the charge transport layer after silica dispersion. These silanes are employed in hydrolyzed forms because the OH groups of the hydrolyzed silanes readily react with the silanol functional groups of the microcrystalline silica surfaces and condense to form siloxane bonds at elevated temperature. The condensation reaction between the OH and silanol groups will position the siloxane at the surfaces of the silica particles and orient the organo-functional group outward to interact with the film forming polymer binder of the charge transport layer. The silane polymer interaction is expected to produce the filler reinforcement effect.

The hydrolyzed silane solution which may be utilized to treat the microcrystalline silica may be prepared by hydrolyzing the alkoxy groups of a silane in an excess amount of water to form a dilute aqueous solution having about 0.1 weight percent to about 5.0 weight percent silane. A solution pH between about 9 and 13 is preferred. The control of the pH of the hydrolyzed silane solution may be achieved by acetic acid or hydrogen iodide addition. The silane microcrystalline silica surface treatment may be effected by washing the silica particles in the dilute hydrolyzed silane solution for about 1 minute to about 30 minutes. The resulting silica particles are filtered with a filter paper and dried at 135° C. in an oven for about 30 minutes to complete the silane surface treatment process. Alternatively, hydrolysis of the silane and surface treatment may also be effected directly at the surfaces of the microcrystalline silica particles as described, for example, in Example 2 of U.S. Pat. No. 3,915,735.

Other micrometer size inorganic fillers having high hardness and exceptional wear resisting properties include, for example, diamond (Moh hardness 10), corundum (Moh hardness 9) and topaz (Moh hardness 8).

The organic fillers selected for charge transport layer dispersion include ALGOFLON, POLYMIST, and ACUMIST. These fillers are preferred because their dispersions in the charge transport layer do not affect the electrical function of the resulting photoconductive imaging device. Other organic fillers, for example KYNAR and metal stearates, disclosed in U.S. Pat. No. 4,869,982, affect the optical or electrical integrity of the charge transport layer.

ALGOFLON, available from Ausimont U.S.A., Inc., comprises irregular shaped polytetrafluoroethylene (PTFE) particles. This filler has inherent slipping characteristics. When dispersed in the charge transport layer, ALGOFLON lowers the surface contact friction of the charge transport layer and eases the sliding mechanical interaction of the surface to minimize wear.

POLYMIST, available from Ausimont U.S.A., Inc., comprises irregular shaped PTFE particles which are similar to ALGOFLON, with the exception that the particles are gamma ray irradiated to increase their hardness. As a result of gamma ray irradiation, the POLYMIST exhibits improved wear properties when incorporated into the charge transport layer.

ACUMIST, available from Allied-Signal, Inc., comprises irregular shaped micronized waxy polyethylene particles having the molecular formula $CH_3(CH_2)_mCH_3$, in which m is a number of repeating units for a molecular weight between about 2000 and about 3500. The oxidized form of ACUMIST is a polyethylene homopolymer having a molecular formula $CH_3(CH_2)_mCH_2COOH$.

The above inorganic and organic fillers, as supplied by the manufacturers, have particle size distributions from about 0.1 micrometer to about 9 micrometers in diameter. For charge transport layer dispersion, these fillers are classified to give a preferred particle diameter range between about 0.1 micrometer and about 4.5 micrometers, with an average particle diameter of about 2.5 micrometers. If an overcoating layer is to be applied onto the charge transport layer, these fillers should be classified further to yield an optimum particle size range from about 0.1 micrometer to about 1.5 micrometers when used in the thin overcoating dispersion.

In the above layers, the particulate materials of the present invention may be incorporated directly into the solutions used to prepare the exposed layers such as the charge transport layer and/or optional overcoat. These exposed layers may be filled with the particulate material to reduce the coefficient of friction, increase wear properties, and improve tensile cracking resistance of the layers without adversely affecting the optical and electrical functions of the imaging member.

The coating solutions of the invention can be applied by any of a number of known photoreceptor fabricating techniques. Typical coating techniques include solvent coating, extrusion coating, spray coating, dip coating, lamination, solution spin coating and the like. Further, the coating solutions can be used with seamless organic photoreceptor belt processes. The coated solutions may be dried by conventional drying techniques such as oven drying, forced air drying, circulating air oven drying, radiant heat drying, and the like.

The particulate material of the invention can be present in the charge transport layer of the imaging member in a range of about 0.1% to about 20% by weight, preferably less than 10% by weight, based on the weight of solids in the coating solutions for the layers.

Optimum results are obtained when the coating mixture for the charge transport layer contains particulate material in a concentration of between about 0.5% by weight and about 5% by weight based on the polymer binder and charge transporting molecules in the charge transport layer.

Optimum results are obtained when the coating mixture for an overcoating layer contains particulate material in a concentration of between about 0.5% by weight and about 5% by weight based on the polymer binder and any other overcoating layer material in the overcoating layer.

The inorganic and organic filler particles of the present invention increase resistance to fatigue cracking in the charge transport layer and in the optional overcoat layer. Fillers having a high surface area increase cracking resistance by facilitating reattachment of ruptured chain segments to filler particles, attachment of dangling chains to filler particles, and sliding of chains over filler particles.

With the layers of the present invention, a decrease in surface contact friction is seen compared with layers which do not have the particles. Wear resistance is increased, resistance to tensile stress cracking in the charge transport layer is increased, and adhesion at the interface between the charge transport layer and charge generating layer is promoted. Since the refractive index of the inventive particles is closely matched with that of the polymer binder, the optical clarity of the charge transport layer or optional overcoat layer is maintained. Very importantly, these advantageous effects are obtained without producing a negative electrical impact on the resulting photoconductive imaging member.

The invention will further be illustrated in the following non-limitative examples, it being understood that these examples are intended to be illustrative only and that the invention is not intended to be limited to the materials, conditions, process parameters and the like recited herein.

COMPARATIVE EXAMPLE I

A photoconductive imaging member is prepared by providing a titanium coated polyester (Melinex available from ICI Americas Inc.) substrate having a thickness of 3 mils, and applying thereto, using a gravure applicator, a solution containing 50 grams 3-aminopropyltriethoxysilane, 15 grams acetic acid, 684.8 grams of 200 proof denatured alcohol and 200 grams heptane. This layer is then dried for 10 minutes at 135° C. in a forced air oven. The resulting blocking layer has a dry thickness of 0.05 micrometer.

An adhesive interface layer is then prepared by applying a wet coating over the blocking layer, using a gravure applicator, containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is then placed on a shaker for 10 minutes. The resulting slurry is thereafter applied to the adhesive interface with an extrusion die to form a layer having a wet thickness of about 0.5 mil. However, a strip about 3 mm wide along one edge of the substrate, blocking layer and adhesive layer is deliberately left uncoated by any of the photogenerating layer material to facilitate adequate electrical contact by the ground strip layer that is applied later. This photogenerating layer is dried at 135° C. for 5 minutes in a forced air oven to form a photogenerating layer having a dry thickness of 2.3 micrometers.

This member is then coated over with a charge transport layer. The charge transport coating solution is prepared by introducing into an amber glass bottle in a weight ratio of 1:1 N,N'-diphenyl-N,N'-bis(3-methylphenyl)-1,1'-biphenyl-4,4'-diamine and the binder resin Makrolon 5705, a polycarbonate having a weight average molecular weight from about 50,000 to about 1,000,000, available from Farbenfabricken Bayer AG. The resulting mixture is dissolved in methylene chloride to provide a 15 weight percent solution thereof. This solution is then applied onto the photogenerator layer with a 3 mil gap Bird applicator to form a wet charge transport layer. During this coating process the relative humidity is maintained at about 14 percent. The resulting photoconductive member is then annealed at 135° C. in a forced air oven for 5 minutes to produce a 24 micrometers dry thickness charge transport layer.

EXAMPLE II

A photoconductive imaging member having two electrically operative layers as described in Comparative Example I is prepared using the same procedures and materials except that a charge transport layer of the invention is used to replace the charge transport layer of Example I. The charge transport layer solution of the invention is prepared by dissolving 75 grams of Makrolon and 75 grams of N,N -diphenyl-N,N'-bis(3-methylphenyl)-1,1'-biphenyl-4,4'-diamine in 850 grams of methylene chloride. 1.5 grams of microcrystalline silica, available from Malvern Minerals Company, is added to the solution. With the aid of a high shear blade disperser (Tekmar Dispax Disperser), the silica particles are dispersed in the solution in a water cooled, jacketed container to prevent the mixture from overheating and losing solvent due to evaporation. The microcrystalline silica is irregular shaped quartz particles of natural occurrence. They are classified to obtain a particle size range between about 0.1 micrometer and about 4.5 micrometers in diameter. The average particle diameter is about 2.5 micrometers.

The resulting dispersion is then applied onto the charge generating layer using a 3 mil gap Bird applicator. The fabricated imaging device having the wet coating is dried at 135° C. for five minutes in a forced air oven to give a 24 micrometers dry thickness charge transport layer containing 1 weight percent microcrystalline silica.

EXAMPLE III

A photoconductive imaging member having two electrically operative layers is fabricated using the same procedures and materials as described in Example II except that the microcrystalline silica content in the 24 micrometers thick dried charge transport layer is 2 weight percent.

EXAMPLE IV

A photoconductive imaging member having two electrically operative layers is fabricated using the same procedures and materials as described in Example II, except that the microcrystalline silica content in the 24 micrometers dry thickness charge transport layer is 3 weight percent.

EXAMPLE V

A photoconductive imaging member having two electrically operative layers is fabricated using the same procedures and materials as described in Example II except the surfaces of the microcrystalline silica particles are treated with chloropropyl triethoxy silane, $Cl(CH_2)_3—Si(OC_2H_5)_3$. The microcrystalline silica content in the 24 micrometers dry thickness charge transport layer is 1 weight percent.

EXAMPLE VI

A photoconductive imaging member having two electrically operative layers is fabricated using the same procedures and materials as described in Example V except that the chloropropyl triethoxy silane treated microcrystalline silica content in the 24 micrometers dry thickness charge transport layer is 3 weight percent.

EXAMPLE VII

A photoconductive imaging member having two electrically operative layers is fabricated using the same procedures and materials as described in Example II except that the surfaces of the microcrystalline silica are treated with azido silane, $$N_3\overset{\overset{\displaystyle O}{\|}}{\underset{\underset{\displaystyle O}{\|}}{S}}—R—Si(OC_2H_5)_3.$$

The microcrystalline silica content in the 24 micrometers dry thickness charge transport layer is 1 weight percent.

EXAMPLE VIII

A photoconductive imaging member having two electrically operative layers is fabricated using the same procedures and materials as described in Example VII except that the azido silane treated microcrystalline silica content in the 24 micrometers dry thickness charge transport layer is 3 weight percent.

EXAMPLE IX

A photoconductive imaging member having two electrically operative layers as described in Comparative Example I is fabricated following the same procedures and using the same materials with the exception that the charge transport layer is replaced by a charge transport layer of the present invention. The charge transport layer solution is prepared by dispersing 1.5 grams ALGOFLON, PTFE particles available from Ausimont U.S.A., Inc., in a solution containing 75 grams of Makrolon, 75 grams of N,N'-diphenyl-N,N'-bis(3-methylphenyl)-1,1'-biphenyl-4,4'-diamine, and 850 grams of methylene chloride. With the aid of a high shear blade disperser (Tekmar Dispax Disperser), the solution with the ALGOFLON particles is dispersed in a water cooled, jacketed container to prevent the mixture from overheating and losing solvent due to evaporation. The ALGOFLON particles are irregular shape (PTFE) and are classified to obtain a particle size range of between about 0.1 micrometer and about 4.5 micrometers in diameter. The average particle size is about 2.5 micrometers.

The resulting dispersion is then applied onto the charge generating layer using a Bird applicator to give a 3 mil wet coating. The fabricated imaging member is dried at 135° C. for 5 minutes in a forced air oven to produce a 24 micrometers dry thickness charge transport layer containing 1 weight percent ALGOFLON.

EXAMPLE X

A photoconductive imaging member having two electrically operative layers is prepared using the same procedures and materials as described in Example IX except that the ALGOFLON content in the 24 micrometers dry thickness charge transport layer is 3 weight percent.

EXAMPLE XI

A photoconductive imaging member having two electrically operative layers as described in Example IX is fabricated using the same procedures and materials except that the 24 micrometers dry thickness charge transport layer contains 1 weight percent POLYMIST. POLYMIST comprises PTFE particles, available from Ausimont U.S.A., Inc. They are irregular shaped particles and have been treated with gamma ray irradiation to enhance particle hardness. They are classified to provide a particle size range of between about 0.1 micrometer and about 4.5 micrometers in diameter. The average particle size is about 2.5 micrometers.

EXAMPLE XII

A photoconductive imaging member having two electrically operative layers is prepared using the same procedures and materials as described in Example XI except that the 24 micrometers dry thickness charge transport layer contains 3 weight percent POLYMIST.

EXAMPLE XIII

A photoconductive imaging member having two electrically operative layers as described in Example IX is fabricated using the same procedures and materials except that ACUMIST particles are selected for charge transport layer incorporation. The ACUMIST content in the 24 micrometers dry thickness charge transport layer is 1 weight percent. ACUMIST comprises micronized waxy polyethylene particles, available from Allied-Signal, Inc., having a molecular formula $CH_3(CH_2)_mCH_3$, and a molecular weight between about 2000 and about 3500. For better sample preparation, the ACUMIST particles are classified to provide a particle size range of between about 0.1 micrometer and about 4.5 micrometers in diameter. The average particle diameter is about 2.5 micrometers.

EXAMPLE XIV

A photoconductive imaging member having two electrically operative layers is fabricated using the same procedures and materials as described in Example XIII except that the ACUMIST content in the 24 micrometers dry thickness charge transport layer is 3 weight percent.

COMPARATIVE EXAMPLE XV

A photoconductive imaging member having two electrically operative layers is fabricated using the same procedures and materials as described in Example XIII, except tin stearate or zinc stearate is used as a filler in the charge transport layer. The tin stearate or zinc stearate present in the 24 micrometers dry thickness charge transport layer is 3 weight percent.

EXAMPLE XVI

The photoconductive imaging members of Examples I to XV are tested for tensile cracking strain, 180° peel strength, and coefficient of friction. Tensile cracking strain is determined by cutting several 1.27 cm×10.16 cm imaging member samples, inserting one sample into the jaws of an Instron Tensile Tester using a 5.08 cm gauge, and pulling the sample to 3% strain with a 5.1 mm/min crosshead speed. The test sample is then removed from the Instron Tensile Tester and examined for charge transport layer cracking under a reflection optical microscope at 100 times magnification. If charge transport layer cracking does not occur, a fresh sample is tested following the same procedures, but at an increased incremental strain 0.25% higher than the previous one. The tensile strain testing is repeated, each time with a fresh sample, until charge transport layer cracking becomes evident. The strain at which the cracking occurs is recorded as the charge transport layer's tensile cracking strain. The 180° peel strength is determined by cutting a minimum of three 0.5 inch×6 inches imaging member samples from each of Examples I to XV. For each sample, the charge transport layer is partially stripped from the test sample with the aid of a razor blade and then hand peeled to about 3.5 inches from one end to expose the underlying charge generating layer inside the sample This stripped sample is then secured to a 1 inch×6 inches×0.5 inch aluminum backing plate (with the anti-curl layer facing the backing plate) with the aid of two sided adhesive tape. The end of the resulting assembly opposite the end from which the charge transport layer was not stripped is inserted into the upper jaw of an Instron Tensile Tester. The free end of the partially peeled charge transport layer is inserted into the lower jaw of the Instron Tensile Tester. The jaws are then activated at a one inch/min crosshead speed, a two inches chart speed and a load range of 200 grams, to 180° peel the sample at least two inches. The load is calculated to give the peel strength of the sample. The peel strength is determined to be the load required for stripping the charge transport layer divided by the width of the test sample.

The coefficient of friction test is conducted by fastening the photoconductive imaging member of Example I, with its charge transport layer (having no filler addition) facing up, to a platform surface. A polyurethane elastomeric cleaning blade is then secured to the flat surface of the bottom of a horizontally sliding plate weighing 200 grams. The sliding plate is dragged in a straight line over the platform, against the horizontal test sample surface, with the surface of the cleaning blade facing downwardly. The sliding plate is moved by a cable which has one end attached to the plate and the other end threaded around a low friction pulley and fastened to the jaw of the Instron Tensile Tester. The pulley is positioned so that the segment of the cable between the weight and the pulley is parallel to the surface of the flat horizontal test surface. The cable is pulled vertically upward from the pulley by the jaw of the Instron Tensile Tester and the load which is required to slide the cleaning blade over the charge transport layer surface is monitored with a chart recorder. The coefficient of friction test for the charge transport layer against the cleaning blade is repeated again as described but the photoconductive imaging member of Example I is replaced with each invention sample of Examples II to XV having 1, 2 or 3 weight percent filler incorporation in the charge transport layers. The coefficient of friction is calculated by dividing the load by 200 grams.

The results obtained for tensile cracking strain, 180° peel strength and coefficient of friction measurements are tabulated in Table I below:

TABLE I

| Example | Cracking Strain (%) | 180° Peel Strength (g/cm) | Coeff. Of Friction Against Blade |
|---|---|---|---|
| I (control) | 3.25 | 98.8 | 3.8 |
| II | 3.50 | 99.3 | 3.0 |
| III | 3.75 | 100.3 | 2.5 |
| IV | 4.00 | 102.1 | 1.9 |
| V | 3.50 | 99.8 | 3.0 |
| VI | 4.00 | 101.4 | 2.1 |
| VII | 3.50 | 99.5 | 2.8 |
| VIII | 4.25 | 102.3 | 2.0 |
| IX | 3.50 | 99.6 | 2.4 |
| X | 4.00 | 101.9 | 1.7 |
| XI | 3.50 | 99.7 | 2.3 |
| XII | 4.00 | 101.1 | 1.6 |
| XIII | 3.50 | 99.3 | 2.5 |
| XIV | 4.00 | 100.8 | 1.8 |
| XV (control) | 3.75 | 99.8 | 2.0 |

The results shown that the resistance of a charge transport layer against tensile stress cracking is improved. Even with the presence of only 1 weight percent of either inorganic filler or organic filler of the present invention, the filler reinforcement effect has been clearly demonstrated. The observed tensile cracking resistance enhancement is expected to extend the dynamic fatigue cracking life of the charge transport layer by more than two times (depending on the level of filler loading) against small 19 mm diameter belt module rollers during machine function.

As reflected by the 180° peel measurement, filler incorporation in the charge transport layer has been seen to improved the interfacial bond strength between the charge transport layer and the charge generating layer. The concept of the present invention also produces a marked reduction in the charge transport layer's frictional property against cleaning blade mechanical interaction. It should also be emphasized that filler addition in the charge transport layer may enhance toner image transfer to the receiving paper and eliminate deletion defects in print copy during xerographic processes.

EXAMPLE XVII

The photoconductive imaging members of Examples I to XV are cut to the size of 1 inch by 12 inches and tested for resistance to wear. Testing is effected by means of a dynamic mechanical cycling device in which glass tubes are skidded across the surface of the charge transport layer on each photoconductive imaging member. More specifically, one end of the test sample is clamped to a stationary post and the sample is looped upward over three equally spaced horizontal glass tubes and then downwardly over a stationary guide tube through a generally inverted "U" shaped path with the free end of the sample secured to a weight which provides one pound per inch width tension on the sample. The face of the imaging member bearing the charge transport layer is facing downward such that it is allowed to contact the glass tubes. The glass tubes have a diameter of one inch. Each tube is secured at each end to an adjacent vertical surface of a pair of disks that are rotatable about a shaft connecting the centers of the disks. The glass tubes are parallel to and equidistant from each other and equidistant from the shaft connecting the centers of the disks. Although the disks are rotated about the shaft, each glass tube is rigidly secured to the disk to prevent rotation of the tubes around each individual tube axis. Thus, as the disk rotates about the shaft, two glass tubes are maintained at all times in sliding contact with the surface of the charge transport layer. The axis of each glass tube is positioned about 4 cm from the shaft. The direction of movement of the glass tubes along the charge transport layer surface is away from the weighted end of the sample toward the end clamped to the stationary post. Since there are three glass tubes in the test device, each complete rotation of the disk is equivalent to three wear cycles in which the surface of the charge transport layer is in sliding contact with a single stationary support tube during testing. The rotation of the spinning disk is adjusted to provide the equivalent of 11.3 inches per second tangential speed. The extent of the charge transport layer wear is measured using a permascope after 165,000 wear cycles and at the end of a 330,000 wear cycles testing. The wear results are listed in the following Table II:

TABLE II

| Examples | After 165,000 wear cycles (micrometers) | After 330,000 wear cycles (micrometers) |
|---|---|---|
| I (Control) | 6.0 | 11.5 |
| II | 4.0 | 7.6 |
| III | 3.1 | 6.0 |
| IV | 2.1 | 4.0 |
| V | 4.0 | 7.5 |
| VI | 2.0 | 4.0 |
| VII | 3.8 | 7.7 |
| VIII | 2.0 | 3.5 |
| IX | 4.6 | 8.5 |
| X | 2.7 | 5.6 |
| XI | 4.2 | 7.8 |
| XII | 2.3 | 4.5 |
| XIII | 4.6 | 8.8 |
| XIV | 3.0 | 6.0 |
| XV (Control) | 4.1 | 7.5 |

These results indicate that the wear resistance of the charge transport layer having any of the invention fillers is improved by over two times when filler loading is at 3 weight percent. Microcrystalline silica (which is a naturally occurring quartz particle) with or without silane coupling agent treatment is seen to give better wear resisting results for the charge transport layer than the organic filler counterparts due to its hardness and intrinsic wear resistant property.

EXAMPLE XVIII

The electrical properties of the photoconductive imaging samples prepared according to Examples I to XV are evaluated with a xerographic testing scanner comprising a cylindrical aluminum drum having a diameter of 9.55 inches. The test samples are taped onto the drum. When set to rotation, the drum which carries the samples produces a constant surface speed of 30 inches per second. A direct current pin corotron, exposure light, erase light, and five electrometer probes are mounted around the periphery of the mounted photoreceptor samples. The sample charging time is 33 milliseconds. Both exposed and erase light are broad band white light (400–700 nm) outputs, each supplied by a 300 watt output Xenon arc lamp. The relative locations of the probes and lights are indicated in Table III below:

TABLE III

| Element | Angle (Degrees) | Position | Distance From Photoreceptor |
|---|---|---|---|
| Charge | 0 | 0 | 18 mm (Pins)<br>12 mm (shield) |
| Probe 1 | 22.50 | 47.9 mm | 3.17 mm |

TABLE III-continued

| Element | Angle (Degrees) | Position | Distance From Photoreceptor |
|---|---|---|---|
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples are first rested in the dark for at least 60 minutes to ensure achievement of equilibrium with the testing conditions at 40% relative humidity and 21° C. Each sample is then negatively charged in the dark to a development potential of about 900 volts. The charge acceptance of each sample and its residual potential after discharge by front erase exposure to 400 ergs/cm$^2$ of light exposure are recorded. The test procedure is repeated to determine the photo induced discharge characteristic (PIDC) of each sample by different light energies of up to 20 ergs/cm$^2$. The 50,000 cycle electrical testing results obtained for the test samples of Examples I through XV are collectively tabulated in the following Table IV.

TABLE IV

| Example | Dark Decay Rate (V/sec) | Residual Potential (V) | 50K Cycles Cycle-down (V) |
|---|---|---|---|
| I (Control) | 150 | 9 | 55 |
| II | 151 | 10 | 55 |
| III | 150 | 11 | 52 |
| IV | 151 | 8 | 55 |
| V | 151 | 9 | 54 |
| VI | 150 | 10 | 52 |
| VII | 151 | 8 | 56 |
| VIII | 150 | 10 | 53 |
| IX | 152 | 11 | 55 |
| X | 151 | 10 | 54 |
| XI | 150 | 10 | 56 |
| XII | 151 | 8 | 52 |
| XIII | 152 | 12 | 57 |
| XIV | 152 | 11 | 58 |
| XV (Control) | 254 | 45 | 386 |

The 50,000 cycles electrical data show that addition of fillers, either inorganic or organic, in the range between 1 and 3 weight percent in the charge transport layer for test imaging samples of Examples II to XIV give equivalent dark decay rates, residual voltage, photo induced discharge characteristics and 50,000 cycles cycle-down when compared to the control sample of Example I. However, the imaging sample of Example XV, having 3 weight percent tin or zinc stearate in the charge transport layer, exhibits a high dark decay rate, large residual voltage, and marked deviation in PIDC from the control sample. Moreover, its 50,000 cycles cycle-down, at 386 volts, is approximately seven times larger than the control result obtained for the control counterpart of comparative Example I.

Unlike the photoconductive imaging member of Example XV, loaded with 3 weight percent tin or zinc stearate in the charge transport layer, which produces good mechanical results but degrades the electrical integrity of the imaging member, the mechanical and electrical cyclic results obtained for the test samples of Examples II to XIV are of particular importance. They indicate that incorporation of specific inorganic and organic fillers of the present invention into the charge transport layer not only improves the desired mechanical and frictional properties of the charge transport layer, but also maintain the crucial electrical integrity of each photoconductive imaging member. Metal stearates, though organic particulates, are distinctly different from the other organic fillers described above because they are salts derived from saponification between high molecular weight fatty acids and bases. The poor electrical results from stearates may suggest that salt particulates, which are reaction products between acids and bases, are unacceptable when used for charge transport layer mechanical enhancement because they may affect the resulting imaging member's electrical function.

In addition, addition of microcrystalline silica (with chlorosilane or azido silane treatment, or without silane treatment at all) or organic fillers into the charge transport layer as described in Examples II to XIV, at loading levels from about 1 to about 3 weight percent, does not alter the charge transport layer's optical clarity. The maintenance of light transmittancy in this layer is essential to allow proper photoelectric function during xerographic imaging processes.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a charge transport layer comprised of a thermoplastic film forming binder, aromatic amine charge transport molecules and a homogeneous dispersion of at least one of organic and inorganic particles having a particle diameter less than about 4.5 micrometers, said particles comprising a material selected from the group consisting of microcrystalline silica, ground glass, synthetic glass spheres, diamond, corundum, topaz, polytetrafluoroethylene, and waxy polyethylene, wherein said particles do not decrease the optical transmittancy or photoelectric functioning of said layer.

2. The electrophotographic imaging member of claim 1, wherein said dispersed particles have a particle diameter substantially less than a thickness of said charge transport layer.

3. The electrophotographic imaging member of claim 1, wherein said layer comprises about 0.1% by weight to about 10% by weight of said particles.

4. The electrophotographic imaging member of claim 1, wherein said particles have a particle diameter of about 0.1 micrometer to about 4.5 micrometers and an average particle diameter of about 2.5 micrometers.

5. The electrophotographic imaging member of claim 1, wherein said particles are naturally occurring microcrystalline silica particles.

6. The electrophotographic imaging member of claim 5, wherein said microcrystalline silica particles have a Moh hardness of at least 7.

7. The electrophotographic imaging member of claim 6, wherein said charge transport layer comprises about 0.1% by weight to about 10% by weight of said microcrystalline silica particles.

8. The electrophotographic imaging member of claim 4, wherein surfaces of said microcrystalline silica particles are treated with a bifunctional silane coupling agent.

9. The electrophotographic imaging member of claim 8, wherein said bifunctional silane coupling agent is a hydrolyzed chlorosilane having a molecular structure:

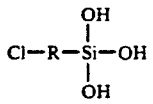

wherein R is an alkylidene group containing 1 to about 20 carbon atoms.

10. The electrophotographic imaging member of claim 8, wherein said bifunctional silane coupling agent is a hydrolyzed azido silane having a molecular structure:

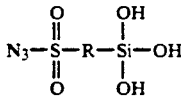

wherein R is an alkylidene group containing 1 to about 20 carbon atoms.

11. The electrophotographic imaging member of claim 1, wherein said material is selected from the group consisting of polytetrafluoroethylene, gamma ray irradiated polytetrafluoroethylene, and waxy polyethylene.

12. The electrophotographic imaging member of claim 11, wherein said charge transport layer comprises about 0.1% by weight to about 10% by weight of said particles.

13. The electrophotographic imaging member of claim 1, wherein said charge transport molecules have the formula:

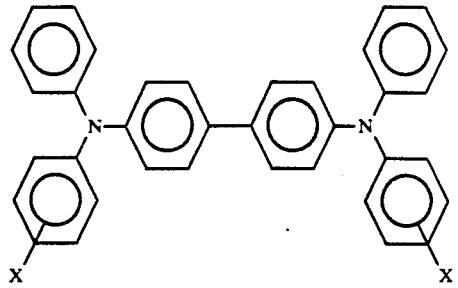

wherein X is selected from the group consisting of an alkyl group having from 1 to 4 carbon atoms and chlorine.

14. An electrophotographic imaging member comprising a supporting substrate having an electrically conductive layer, a hole blocking layer, an adhesive layer, a charge generating layer, a charge transport layer, and optionally an overcoating layer, at least one of said charge transport layer and said overcoating layer comprising a homogeneous dispersion of particles selected from the group consisting of microcrystalline silica, ground glass, synthetic glass spheres, diamond, corundum, topaz, polytetrafluoroethylene, and waxy polyethylene, wherein said particles do not decrease the optical transmittancy or photoelectric functioning of said at least one of said charge transport layer and said overcoating layer.

15. The electrophotographic imaging member of claim 14, wherein said dispersed particles have a particle diameter substantially less than the thickness of the layer containing said particles.

16. The electrophotographic imaging member of claim 14, wherein said particles have a particle diameter of about 0.1 micrometer to about 1.5 micrometers.

17. The electrophotographic imaging member of claim 14, wherein said particles have an average diameter of about 0.8 micrometers.

18. The electrophotographic imaging member of claim 14, wherein said overcoating layer comprises about 0.1% by weight to about 10% by weight of said particles.

19. The electrophotographic imaging member of claim 14, wherein said particles consist of microcrystalline silica having a Moh hardness of at least 7.

20. The electrophotographic imaging member of claim 14, wherein said particles comprise a material selected from the group consisting of polytetrafluoroethylene, gamma ray irradiated polytetrafluoroethylene and waxy polyethylene of the molecular formula $CH_3(CH_2)_mCH_3$ and oxidized forms thereof, wherein m is a number of repeating units for a molecular weight between about 2000 and about 3500.

* * * * *